US005839015A

United States Patent [19]

Faguy et al.

[11] Patent Number: 5,839,015

[45] Date of Patent: Nov. 17, 1998

[54] PAPER HEIGHT MEASURE APPARATUS FOR A MEDIA TRAY WITH LINEAR SENSOR

[75] Inventors: Gary A. Faguy, Hamilton; David G. Joyce, Richmond Hill; Joseph Azzopardi, Brampton, all of Canada

[73] Assignee: Xerox Corporation, Stamford, Conn.

[21] Appl. No.: 623,085

[22] Filed: Mar. 28, 1996

[51] Int. Cl.[6] ..... G03G 15/00

[52] U.S. Cl. ..... 399/23; 271/153; 399/393

[58] Field of Search ..... 399/23, 381, 393; 340/674, 675; 270/52.06; 271/152–155

[56] References Cited

U.S. PATENT DOCUMENTS

| | | | |
|---|---|---|---|
| 4,469,320 | 9/1984 | Wenthe, Jr. | 271/98 |
| 4,734,747 | 3/1988 | Okuda et al. | 399/23 |
| 4,788,571 | 11/1988 | Ura et al. | 399/393 |
| 4,835,573 | 5/1989 | Rohrer et al. | 355/308 |
| 4,960,272 | 10/1990 | Wierszewski et al. | 271/3.1 |
| 4,970,544 | 11/1990 | Furusawa et al. | 355/24 |
| 5,078,378 | 1/1992 | Kapadia et al. | 271/3.1 |
| 5,152,515 | 10/1992 | Acquaviva | 271/3.1 |
| 5,360,207 | 11/1994 | Rauen et al. | 271/265 |
| 5,467,182 | 11/1995 | Hower, Jr. et al. | 355/319 |

FOREIGN PATENT DOCUMENTS

| | | |
|---|---|---|
| 0 189 746 A | 8/1986 | European Pat. Off. . |
| 58-119530 | 7/1983 | Japan . |
| 05-139570 | 6/1993 | Japan . |
| 07-061646 | 3/1995 | Japan . |

*Primary Examiner*—Robert Beatty
*Assistant Examiner*—Quana Grainger
*Attorney, Agent, or Firm*—John S. Wagley

[57] ABSTRACT

An apparatus for determining the height of a stack of sheet media in a supply bin is provided. The apparatus includes a sensor and a substantially linearly extending member. The member is operatively associated with the optical sensor to permit relative motion between the sensor and the member. At least one of the sensor and the member moves with the supply bin. The sensor generates a signal indicative of the relative motion between the sensor and the member. The relative motion provides an indication of the height of the stack of the sheet media.

18 Claims, 5 Drawing Sheets

PAPER HEIGHT MEASURE APPARATUS FOR A MEDIA TRAY WITH LINEAR SENSOR

This invention relates generally to a paper tray gauge for a printing machine, and more particularly concerns a multifunction paper tray gauge for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

The productivity of electrophotographic copy machines and printers has increased greatly over the years. Many of these machines are capable of producing 60 to 100 copies per minute and several machines are capable of even higher productivities. These faster, high productive machines require large quantities of paper. In order to maintain the productivity of these machines, the number of machine interruptions to add paper are preferably minimized. Solutions to this paper change problem include the use of multiple paper trays, paper trays which may be accessed during the operating of the machine, and higher capacity paper feeders. The use of higher capacity paper feeders is particularly popular in recent years.

The use of copy machines and printers with cut 8 ½×11 sheets of copy paper and particularly those copy machines that have high capacity output require accurate placement of the sheets to be fed through the copy machine. Typically, these sheets are stacked on trays. The sheets are fed from the trays with the top sheet fed first. This means that the trays are raised and lowered to align the sheet to be fed with a paper feed mechanism located within the machine. For low capacity feed trays, the feed trays may be spring biased with a spring force pushing the top sheet of the tray upward against a stop. The sheet can then be fed from the top.

For higher capacity feeders, for example, for those feeders having a capacity of one thousand sheets or more, the use of spring biased feed trays is increasingly difficult. The greater spring force which is required to urge the trays upwardly interferes with the pulling of the top sheet from the tray.

A solution to this problem is to utilize a motor to position the top sheet of the tray in a constant position in alignment with the feed mechanism. This motor is typically driven by an electrical motor. This motor must position the paper in a fairly accurate alignment with the feed mechanism of the machine. In prior art, high capacity feed trays for copiers and printers the use of a positioning motor with a rotary encoder has been used. Such a system is shown in U.S. Pat. No. 4,960,272 to Wierszewski et al., the relative portions thereof incorporated herein by reference. The rotary encoder is expensive, unreliable and inaccurate. Furthermore, the use of a rotary encoder requires a tray down and a tray up switch to indicate when the tray is full or empty.

A further problem is encountered in that the failure of either the tray down or up switch will indicate to the machine control logic that these switches have not been reached. Therefore, the feed mechanism will continue to operate until it has over traveled and perhaps, caused significant damage to the feed mechanism of the machine. A typical solution to this problem is to add a second or redundant switch to the tray down switch and the tray up switch. The redundant switches are likewise connected to the logic and like the original switches, if the redundant switches become defective the logic would indicate that they have not been actuated either. The redundant switches are somewhat effective in that the concurrent failure of both the tray switches and the redundant switches is somewhat unlikely. The use of these switches is expensive, increases the complexity of the machine, and reduces the reliability of the machine. Further, the use of the switches even including the redundant switches provides only a redundant system and not a fail-safe system. If both the switch and the redundant switch are to fail at the same time, the feed mechanism would still over-travel and wreck.

Further, the positioning ability of the rotary encoder is limited. This limited accuracy results in only a very rough approximation of the amount of paper in the machine. This lack of accuracy in the number of sheets in the tray causes an uncertainty to a machine operator which results in greater attention needed to be given to the machine. In high production print shops and printing departments, the printing operators may be required to operate more than one machine and uncertainty of the amount of paper in the machine requires the operator to pay undue attention to the machine.

The following disclosures may be relevant to various aspects of the present invention:

U.S. patent application Ser. No. 08/286,352
Applicants: Pettocchi et al.
Filing Date: Aug. 5, 1994
U.S. Pat. No. 5,467,182
Inventor: Hower, Jr. et al.
Issue Date: Nov. 14, 1995
U.S. Pat. No. 5,152,515
Inventor: Acquaviva
Issue Date: Oct. 6, 1992
U.S. Pat. No. 5,078,378
Inventor: Kapadia et al.
Issue Date: Jan. 7, 1992
U.S. Pat. 4,970,544
Inventor: Furusawa, et al
Issue Date: Nov. 13, 1990
U.S. Pat. No. 4,960,272
Inventor: Wierszewski et al.
Issue Date: Oct. 2, 1990
U.S. Pat. No. 4,835,573
Inventor: Rohrer et al.
Issue Date: May. 30, 1989
U.S. Pat. No. 4,469,320
Inventor: Wenthe, Jr.
Issue Date: Sep. 4, 1984

The relevant portions of the foregoing disclosures may be briefly summarized as follows:

U.S. patent application Ser. No. 08/286,352 discloses an apparatus for determining the dimensions of a stack of sheets in the tray. An optical sensor is arranged so that movement of the sheet guides in a paper tray causes a variably graduated scale to be moved past the sensor. The sensor may either be a transmissive or reflective type analog sensor in which the strength of the signal generated by the sensor is converted into a position of the side guides and as the analog scale is continuously variable, there is no need for separate discrete sensors or switches and sheet sizes of any dimension can be accommodated. A recalibration process is used to prevent contamination of the gauge and the associated change in signal strength by this sensor from causing the size determinations to be inaccurate. Alternatively, a digital sensor in cooperation with a digital bar code or other digital scale can be utilized to determine the variable sheet size, which digital sensor and variable scale are insensitive to contamination by dirt or paper particles, etc. The sensor system herein is very robust and provides a simple device for determining the size of a stack of sheets in a paper tray U.S. Pat. No. 5,467,182 discloses a duplex path loop having a acceleration nip cooperating with a belt transport and retime nip to allow duplexing of sheets while minimizing skipped pitches on the photoreceptor. As each sheet to be duplex printed is removed from the process path after first side imaging it is accelerated to create a gap between it and subsequent sheets. The sheet is then stalled or slowed in a retime nip, while subsequent sheets to be duplexed are simultaneously driven by the same transport, the first mentioned sheet being reinserted into the process path at the proper time for receiving the second side image before the arrival of the second sheet at the retime nip. Subsequent duplex sheets are handled in the same manner so that duplex copies are interleaved or otherwise reinserted into the process path with first side copies so that skipped pitches on the photoreceptor are minimized.

U.S. Pat. No. 5,152,515 discloses a stacking system for sequentially feeding flimsy sheets to be stacked in a generally horizontal stack in a stacking tray. The sheets are ejected sequentially out over the stack with a preset sheet ejection trajectory angle to fall by gravity and settle onto the top of the stack. The height of the stack is first estimated to provide a stack height control signal proportional to the height of the stack. The trajectory angle is then changed in response to the control signal.

U.S. Pat. No. 5,078,378 discloses a system for detecting the approximate size of a set or stack of document sheets. A separate system provides rough initial stack height. A counter for counting the sheets fed from the tray is used to compare the sheets fed with the rough initial stack height to improve the accuracy of the rough initial stack height.

U.S. Pat. No. 4,970,544 discloses paper tray control system which includes a tray control separated from the main controller and a communication line between the tray controller and the main controller. Instructions from the main controller is fed by the communication line to the tray controller.

U.S. Pat. No. 4,960,272 discloses feeder stack height detection calibration system. A high resolution rotary encoder and sensor beam is connected to a stack height arm at a pivot point. As the arm is flipped pulses are counted and this information is used to represent one sheet. Software stores this information to create a table of stack heights.

U.S. Pat. No. 4,835,573 discloses data processing elements such as a micro-code which counts the number of sheets feed from a bin and the amount of bin travel. The number of sheet and bin travel yield data include the actual sheet thickness and weights. The amount of bin travel may be controlled by a DC motor.

U.S. Pat. No. 4,469,320 discloses a sheet stack sensor which operates in two modes. The finger member of the sensor controls a feeding mechanism by sensing the height of the stack. The finger also determines when the stack is empty by a second switch when the finger in a second position.

In accordance with one aspect of the present invention, there is provided an apparatus for determining the height of a stack of sheet media in a supply bin. The apparatus includes a sensor and a substantially linearly extending member. The member is operatively associated with the optical sensor to permit relative motion between the sensor and the member. At least one of the sensor and the member moves with the supply bin. The sensor generates a signal indicative of the relative motion between the sensor and the member. The relative motion provides an indication of the height of the stack of the sheet media.

Pursuant to another aspect of the present invention, there is provided an electrophotographic printing machine having a device for determining the height of a stack of sheet media in a supply bin. The device includes a sensor and a substantially linearly extending member. The member is operatively associated with the optical sensor to permit relative motion between the sensor and the member. At least one of the sensor and the member moves with the supply bin. The sensor generates a signal indicative of the relative motion between the sensor and the member. The relative motion provides an indication of the height of the stack of the sheet media.

Pursuant to yet another aspect of the present invention, there is provided a method for determining the height of a stack of sheet media in a supply bin comprising the steps of providing an optical sensor; providing a substantially linearly extending member operatively associated with the optical sensor, permitting relative motion therebetween, generating a signal indicative of the relative motion therebetween, and providing an indication of the height of the stack of the sheet media corresponding to the signal.

Other features of the present invention will become apparent as the following description proceeds and upon reference to the drawings, in which.

Figure 1:
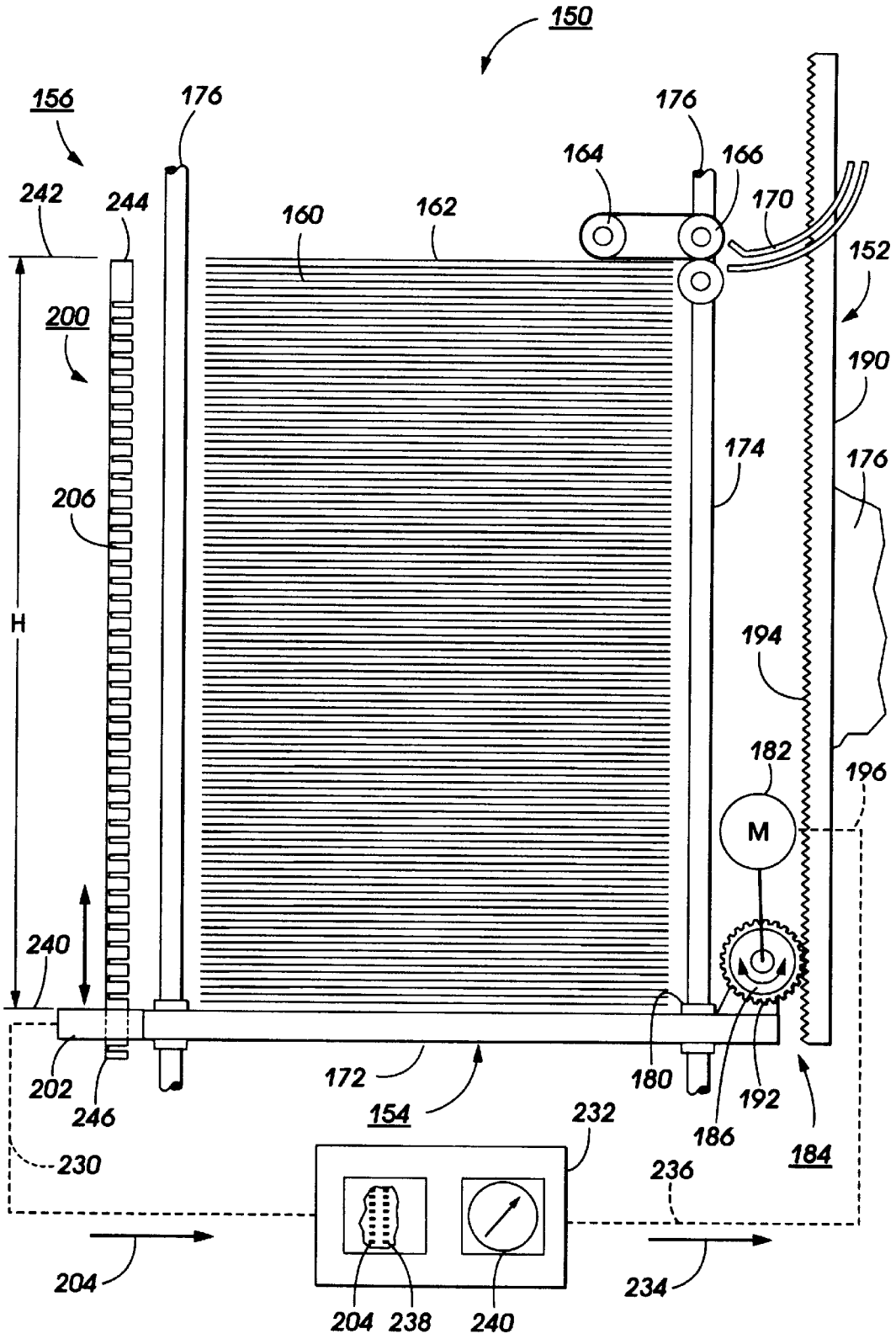
FIG. 1 is an elevational view of a paper tray in the full position using the linear encoder for combined use as paper tray gauge and traydown switch according to the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

FIG. 1 schematically depicts an electrophotographic printing machine incorporating the features of the present invention therein. It will become evident from the following discussion that the linear encoder for combined use as paper tray gauge and traydown switch of the present invention may be employed in a wide variety of devices and is not specifically limited in its application to the particular embodiment depicted herein.

Figure 2:
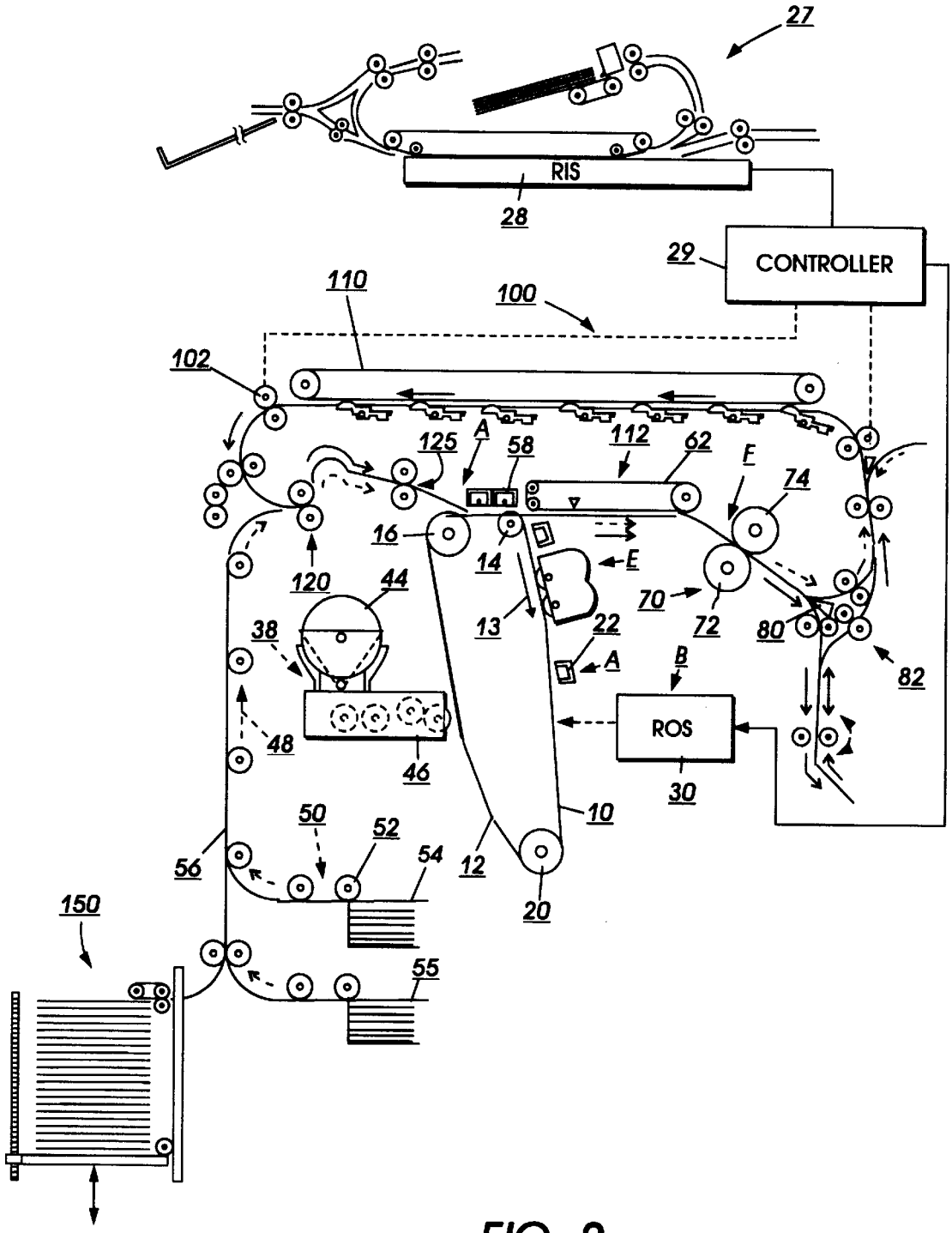
FIG. 2 is a schematic elevational view of an electrophotographic printing machine incorporating the FIG. 1 tray therein.

Referring to FIG. 2 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 2 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 16 and drive roller 20. As roller 20 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. Preferably, a nine facet polygon is used. The ROS illuminates the charged portion of photoconductive belt 10 at a resolution of about 300 or more pixels per inch. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 30 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 16. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, described in further detail below, for recirculation back through transfer station D and fuser 70 for receiving and permanently fixing the side two image to the backside of that duplex sheet, before it exits via exit path 16.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Referring now to FIG. 1, a high capacity sheet feeder 150 is shown. The high capacity sheet feeder 150 is shown in position in a xerographic copy machine in FIG. 2. Referring again to FIG. 1, the high capacity sheet feeder 150 includes a drive assembly 152 which is used to position feeder assembly 154. The position of the feeder assembly 154 is measured by height detection system 156. The feeder assembly 154 contains a large quantity of sheet media 160. Top sheet 162 of the sheet media 160 is fed from the high capacity sheet feeder 150 by any suitable means, for example, as shown in FIG. 1 by a feed roll 164 positioned on the top sheet 162. The feed roll 164 is driven by any suitable means, for example, by motors (not shown). The feed roll 164 advances sheet media 162 through support rolls 166 and then through chute 170 and further into the paper path as shown in FIG. 2.

Referring again to FIG. 1, the feeder assembly 154 may have any structure capable of positioning the sheet media 160 in order that the top sheet 162 is placed adjacent the feed roll 164 to permit the proper feeding of the sheet media 160. For example, as shown in FIG. 1, the feeder assembly 154 may include a platform 172 on which the sheet media 160 are carried. The platform 172 is supported in any suitable manner in order that it may be raised and lowered as the sheet media 160 are removed. For example, the platform 172 may be supported by rails 174 which are affixed to machine frame 176. The platform 172 is guided by rails 174 as it moves upward and downward. The platform 172 may be guided by the rails 174 in any suitable fashion, for example, as shown in FIG. 1, the platform 172 may include bearings 180 which are secured to the platform 172. The bearings 180 are slidably attached to the rails 174 and permit the accurate motion of the platform 172 relative to the rails 174. When rails 174 are used, the feeder assembly 154 may include as few as two rails 174 or preferably, to reduce skew and binding of the platform 172, three or four rails 174 equally spaced along the periphery of the platform 172 are preferred.

Drive assembly 152 is used to properly position the platform 172 of the feeder assembly 154. The drive assembly 152 includes a motor 182 to which mechanism 184 is attached. The motor 182 may be any suitable motor capable of raising and lowering the platform 172 of the feeder assembly 154. For example, the motor 182 may be a positioning motor 182, for example, a DC stepping motor.

The drive mechanism 184 may be any suitable drive mechanism. For example, the drive mechanism may be a chain and sprocket, a series of gears, or as shown in FIG. 1, include a pinion gear 186 which is engaged with and meshes with rack 190. To obtain the relative motion between the pinion 186 and the rack 190, the rack may be translatable in the vertical direction with the pinion gear 186 being fixed, or as shown in FIG. 1, the pinion gear 186 may be movable in the vertical direction with the rack 190 being secured to the machine frame 176. The pinion gear 186 as shown in FIG. 1 moves vertically with the platform 172 of the feeder assembly 154. For example, the pinion gear 186 may be secured to the platform 172 and move vertically therewith. The pinion gear 186 includes teeth 192 which match with teeth 194 on the rack 190. A flexible electric cable 196 permits the motor 182 to travel vertically with the pinion gear 186. The motor 182 may be secured to the pinion gear 186 by any suitable method and for example, the pinion gear 186 may be directly connected to the shaft (not shown) of the motor 182.

Referring again to FIG. 1, according to the present invention, the height detection system 156 is shown. The height detection system 156 includes a linearly extending member 200 which cooperates with a sensor 202. As relative motion between the linearly extending member 200 and the sensor 202 is required, either the linearly extending member 200 or the sensor 202 may be fixed while the other of these two items moves with the feeder assembly 154. Since the sensor 202 is smaller in size than the member 200, preferably, the sensor 202 moves with the platform 172.

While the invention may be practiced with a linearly extending member 200 of any suitable configuration, preferably, the member 200 is in the form of a scale. For example, the scale 200 may be in the form of a fixed encoder strip. The strip 200 may be used either to absorb a signal 204 from the sensor 202, or as shown in FIG. 1, includes transparent segments 206 through which the signal 204 may pass.

The sensor 202 may be any sensor capable of operation with the linearly extending member 200. For example, the sensor 202 may be an optical sensor, a magnetic sensor, or an electronic sensor. Preferably, as shown in FIG. 1, the sensor 202 is in the form of an optical sensor The optical sensor 202 may be in the form of an analog optical sensor or a digital optical sensor. As shown in FIG. 1, preferably, the optical sensor 202 is in the form of an analog optical sensor 202.

Figure 3:
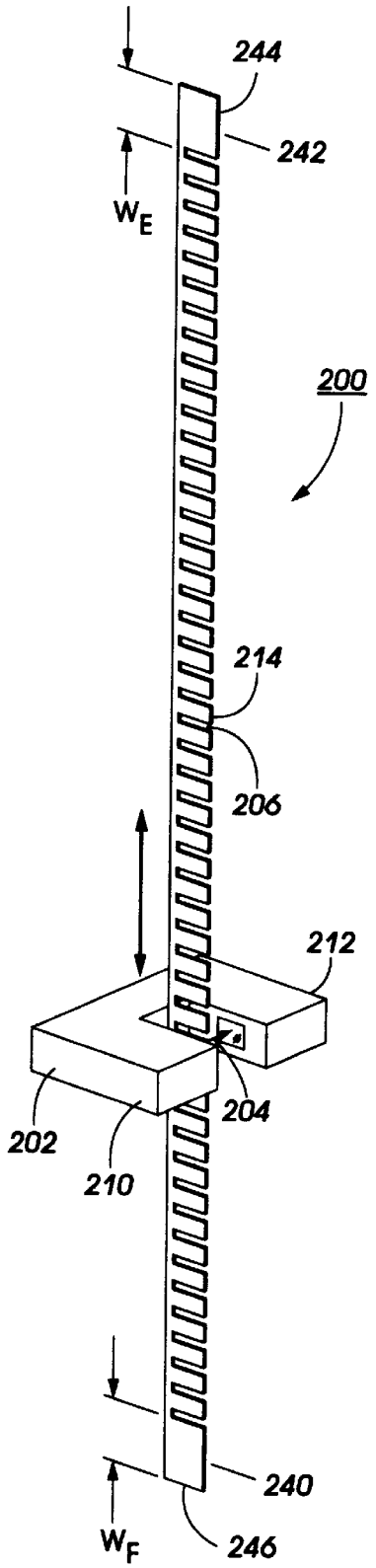
FIG. 3 is a plan view of an optical sensor and scale for the FIG. 1 paper tray.

Referring now to FIG. 3, the strip 200 and the sensor 202 are shown in greater detail. The optical sensor 202 is preferably in the form of a U-channel optical sensor. The signal 204 passes across the sensor 202 from a first tine 210 to a second tine 212 of the sensor. The U-channel sensor 202 may be any standard commercially available U-channel sensor, for example, sensor model no. TR11 2995 from Temics Corporation. The signal 204 contacts encoder strip 200 at either transparent segments 206 or opaque segments 214. When the signal 204 is aligned with transparent segment 206, the signal is transmitted through the segment 206, while when the signal 204 is aligned with opaque segment 214, the signal 204 does not pass through the opaque segment 214.

Figure 4:
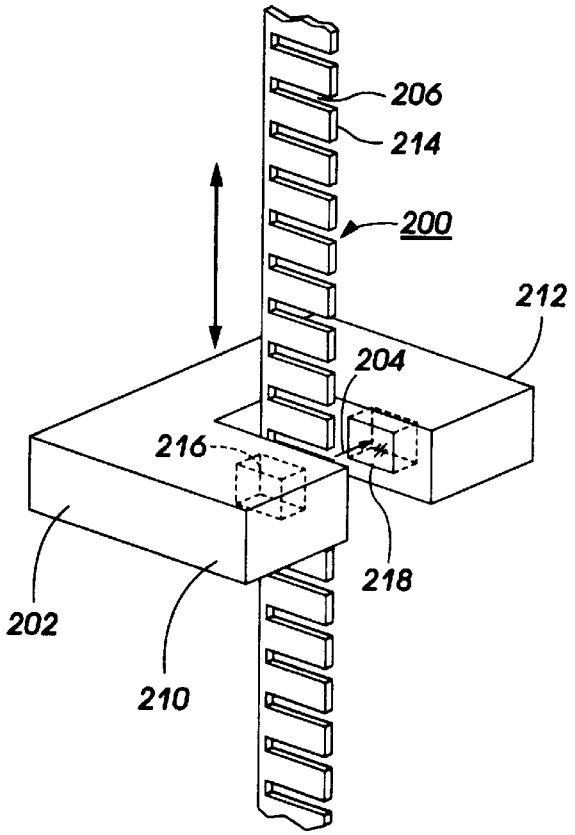
FIG. 4 is a partial plan view of the FIG. 3 optical sensor and scale.

Referring now to FIG. 4, the U-channel sensor 202 and the encoder strip 200 are shown in greater detail. The encoder strip 200 may have any configuration capable of passing and not passing the signal from sensor 202 in spaced apart intervals in the direction of travel of the paper tray. The U-channel sensor 202 includes an optical transmitter 216 located in first tine 210 which sends out the signal 204. When the signal 204 passes through transparent segment 206, the signal 204 may reach optical receiver 218 in the second tine 212 of the sensor 204. If, on the other hand, the optical transmitter 216 sends out signal 204 which impinges on the opaque segment 214, the signal 204 does not reach the optical receiver 218 and a signal can thus not be transmitted. The encoder strip 200 includes the opaque segments 214 and the transparent segments 206. Preferably, the opaque segments 214 and the transparent segments 206 are alternatively positioned next to each other. The transparent segments 206 permit the transfer of the signal from the sensor 202, while the opaque segments prohibit the transfer of the signal from the sensor 202.

Figure 5:
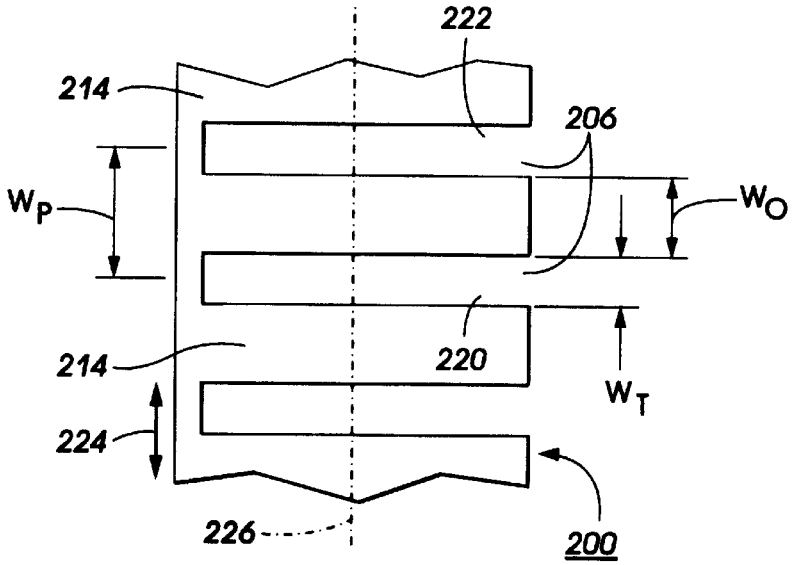
FIG. 5 is a partial plan view of the FIG. 3 scale showing regular and long transparent segments.

Referring now to FIG. 5, the opaque segments 214 and the transparent segments 206 are shown in greater detail. The strip 200 may be made of any suitable durable material. For example the strip 200 may be made from stamped sheet metal or may be molded from a plastic material. The opaque segments 214 may be solid areas of the plastic or sheet metal strip 200, while the transparent segments 206 may be apertures, or slots in the strip 200. The strip 200 preferably includes void in the form of holes or slots, the holes representing the transparent segments 206. Slots as shown in FIG. 5, are preferred to accommodate positioning errors in the sensor 202. The solid areas represent the opaque segments 214. The transparent segments 206 may be centrally located slots in the strip 200, or as shown in FIG. 5, be in the from of rectangular notches in one side of the strip 200.

Typically, the opaque segments 214 have a width $W_o$ approximately equal to a width $W_T$ of the transparent segments 206. The width of the transparent segment $W_T$ and the width $W_o$ of the opaque sections combine to form a distance $W_p$ between adjacent transparent segments 206. The applicants have found that a distance $W_p$ of approximately 2 mm is effective to practice the invention. With an equal width for both width $W_T$ and width $W_o$ and a distance $W_p$ of 2 mm, the width $W_T$ is 1 mm and the width $W_o$ is 1 mm. As the sensor 206 (see FIG. 3) travels from a first transparent segment 220 to a second transparent segment 222, the sensor 202 has moved a distance of 2 mm. The sensor 202 sends a first signal as it passes by first transparent segment 202 and a second signal as it passes by second transparent segment 222. The number of these signals may be added. The summed number of the signals multiplied by the distance $W_p$ per signal will indicate the travel of the sensor 202 in the direction 224 along axis 226 of the strip 200.

Referring again to FIG. 1, signal 204 from sensor 202 is transported via conduit 230 to controller 232. Controller 232 may be capable of receiving signal 204 from sensor 202 and emitting signal 234 to motor 182 through conduit 236 to control the motor 182. The controller 232 adds the signals 204 from the sensor 202 to get a total number 238 of signals 204 which through the controller will be converted into the distance traveled by the sensor and, correspondingly, the position or height H of the platform 172. Since adjoining transparent segments 206 are separated by a distance of approximately 2 mm, the height H of the platform 172 may be determined within 2 mm of its actual position.

Preferably, the controller 232 includes a timer 240 which in conjunction with the signal 204 from the sensor 202 may operate within the controller 232 to determine the time between consecutive signals 204. If the time between consecutive signals 204 exceeds a predetermined amount or an amount calculated from the two prior consecutive signals 204, the controller 232 may determine that the transparent segments 206 and the opaque segments 214 no longer of equal width.

Since the controller 232 is capable of determining when the transparent segment 222 has an exceedingly large width, this feature may be used to detect such occurrences. This feature may be used to detect tray full home position 240 or tray empty home position 242. Referring again to FIG. 3, the encoder strip 200 may include tray empty transparent segment 244 which has a width $W_E$ which is significantly larger than width $W_T$ of the remaining transparent segments 206. Likewise, the strip 200 may include tray full transparent segment 246 which has a width $W_F$ which is significantly greater than width $W_T$ of the transparent segment 206. When the sensor 202 reaches either segment 244 of segment 246, the signal 204 remains on for a period of time which is greater than that preselected from the controller 232. Thus, the controller 232 may be able to determine when the sensor 202 has reached home position 232 or tray full home position 240. Because the height detection system 156 may determine when home positions 242 and 240 have been met, the use of the height detection system 156 may obviate the need for separate home switches. Also, since the signal 204 is transmitted through the transparent sections 244 and 246 for an extended period of time to signal the home positions, the home position sensed by the detection system 156 is fail-safe, in that if the sensor 202 is to fail, the signal 204 will not remain in effect for a period of time greater than that preselected.

Referring again to FIG. 1, the high capacity sheet feeder 150 with height H at its maximum or with the feeder 150 completely full of sheet media 160. The sensor 202 is thus located at position 240 in alignment with tray full transparent segment 246.

Figure 6:
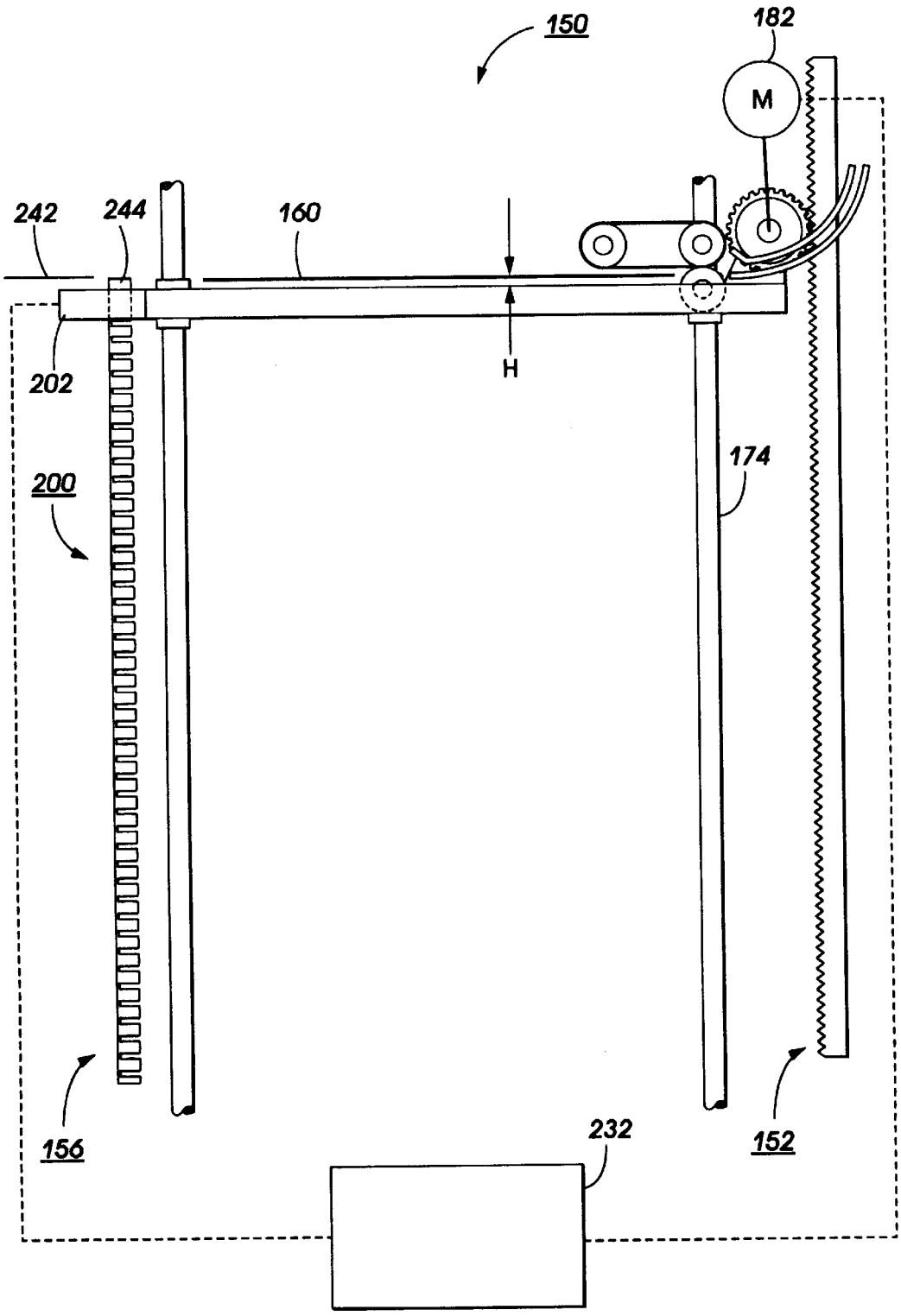
FIG. 6 is an elevational view of the FIG. 1 paper tray in the empty position.

Referring now to FIG. 6, the high capacity sheet feeder 150 is shown with sheet media 160 in an empty situation with the height H of the sheet media being approximately equal to zero. This height H may be equal to approximately 2 mm for the encoder strip 200 heretofore described. The sensor sensor 202 is at tray empty position 242 and in line with tray empty transparent segment 244.

The height detection system of the present invention provides for an inexpensive and highly reliable method of determining fairly accurately the number of sheets in a high capacity sheet feeder.

The height detection system 156 of the present invention provides for significantly improved accuracy in determining the height of the stack of sheet media than that of prior art height detection measurement systems for high capacity sheet feeders.

The use of a height detection system including a U-shaped sensor in conjunction with transparent linearly extending encoder strip, the strip and sensor may also be used as a limit switch by having transparent segments of extended width which in correlation with a controller having a timer may be used to indicate home positions.

By utilizing the height detection system of the present invention including a scale having wide transparent sections, the height detection system may serve as a fail-safe limit switch to protect the motor and drive assembly of the high capacity sheet feeder.

By utilizing the height detection system of the present invention, additional home positions along the encoder strip may be added to indicate other positions of the feeder 150 at no additional cost.

The use of a height detection system of the present invention provides for home position switching at no additional cost and with no additional components which may fail and increase the unreliability of the machine.

In recapitulation, there is provided an apparatus for determining the dimensions of a stack of sheets in the tray. An optical sensor is arranged so that movement of the sheet guides in a paper tray causes a continuously variably graduated scale to be moved past the sensor. The sensor may either be a transmissive or reflective type sensor and the strength of the signal generated by the sensor is converted into a position of the side guides as the scale is continuously variable, there is no need for discrete sensors or switches and sheet sizes of any dimension can be accommodated. A recalibration process is used to prevent contamination of the gauge and the associated change in signal strength by this sensor from causing the size determinations to be inaccurate. Alternatively, a digital sensor in cooperation with a digital bar code or other digital pattern can be utilized to determine the variable sheet size, which digital sensor and variable scale are substantially insensitive to contamination by dirt or paper particles, etc. The sensor system herein is very robust and provides a simple device for determining the size of a stack of sheets in a paper tray.

It is, therefore, apparent that there has been provided in accordance with the present invention, a sheet guide position sensor that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for determining the height of a stack of sheet media in a supply bin, comprising:

an optical sensor; and a substantially linearly extending member operatively associated with said sensor to permit relative motion therebetween, at least one of said sensor and said member moving with the supply bin, said sensor generating a signal indicative of the relative motion between said sensor and said member to provide an indication of the height of the stack of the sheet media wherein said member comprises a strip including a pattern of transparent segments and opaque segments.

2. An apparatus according to claim 1, wherein said sensor transmits an optical signal through said strip, said sensor receiving a substantial portion of said optical signal when said sensor and said transparent segments are aligned and said sensor failing to receive a significant portion of said signal when said opaque segments and said sensor are aligned, whereby the alignment of said transparent segments and said sensor defining high signals and whereby the alignment of said opaque segments and said sensor defining low signals.

3. An apparatus according to claim 2, further comprising a controller for adding the number of transitions from low signals to high signals and the number of transitions from high signals to low signals, for storing information indicative of the length of the transparent segments and the opaque segments and for calculating the height of the stack based on the number of transitions and the length of the transparent segments and the opaque segments.

4. An apparatus according to claim 2, wherein the distance between adjacent opaque segments is substantially identical.

5. An apparatus according to claim 3, wherein said controller further comprises a timer for determining the time between the transitions.

6. An apparatus according to claim 5:

wherein the height of at least one of said segments is substantially greater than the height of the remaining segments;

wherein said segment with the substantially greater height has a greater time between transitions; and wherein said controller distinguishes said segment with the substantially greater height.

7. An apparatus according to claim 6, wherein said segment with the substantially greater height defines a home position for the stack of sheet media.

8. An apparatus according to claim 1, wherein said transparent segments and said opaque segments are alternately positioned relative to one another.

9. An electrophotographic printing machine wherein having a device for determining the height of a stack of sheet media in a supply bin, comprising:

an optical sensor; and a substantially linearly extending member operatively associated with said sensor to permit relative motion therebetween, at least one of said sensor and said member moving with the supply bin, said member comprising a strip including a pattern of transparent segments and opaque segments, said sensor generating a signal indicative of the relative motion between said sensor and said member to provide an indication of the height of the stack of the sheet media.

10. A printing machine according to claim 9, wherein said sensor transmits an optical signal through said strip, said sensor receiving a substantial portion of said optical signal when said sensor and said transparent segments are aligned and said sensor failing to receive a significant portion of said signal when said opaque segments and said sensor are aligned, whereby the alignment of said transparent segments and said sensor defining high signals and whereby the alignment of said opaque segments and said sensor defining low signals.

11. A printing machine according to claim 10, further comprising a controller for adding the number of transitions from low signals to high signals and the number of transitions from high signals to low signals, for storing information indicative of the length of the transparent segments and the opaque segments and for calculating the height of the stack based on the number of transitions and the length of the segments.

12. A printing machine according to claim 11, wherein said controller further comprises a timer for determining the time between the transitions.

13. A printing machine according to claim 12:

wherein the height of at least one of said segments is substantially greater than the height of the remaining segments;

wherein said segment with the substantially greater height has a greater time between transitions; and wherein said controller distinguishes said segment with the substantially greater height.

14. A printing machine according to claim 13, wherein said segment with the substantially greater height defines a home position for the stack of sheet media.

15. A printing machine according to claim 9, wherein said transparent segments and said opaque segments are alternately positioned relative to one another.

16. A printing machine according to claim 15, wherein the distance between adjacent opaque segments is substantially identical.

17. A method for determining the height of a stack of sheet media in a supply bin comprising the steps of:

providing an optical sensor;

providing a substantially linearly extending member operatively associated with the optical sensor;

permitting relative motion therebetween;

transmitting an optical signal through a strip including transparent segments and opaque segments;

receiving a substantial portion of the signal when the sensor and the transparent segments are aligned; and failing to receive a significant portion of the signal when the opaque segments and the sensor are aligned, whereby the alignment of the transparent segments and the sensor define high signals and whereby the alignment of the opaque segments and the sensor define low signals, thereby providing an indication of the height of the stack of the sheet media corresponding to the signal.

18. The method of claim 17, wherein the providing an indication step comprises the steps of:

adding the number of transitions from low signals to high signals and the number of transitions from high signals to low signals;

storing information indicative of the length of the transparent segments and the opaque segments; and calculating the height of the stack based on the number of transitions and the length of the segments.

* * * * *